US005251262A

United States Patent [19]

Suzuki et al.

[11] Patent Number: 5,251,262

[45] Date of Patent: Oct. 5, 1993

[54] ADAPTIVE ACTIVE NOISE CANCELLATION APPARATUS

[75] Inventors: Seiichirou Suzuki, Yokohama; Susumu Saruta, Ebina; Hiroshi Tamura, Yokohama, all of Japan

[73] Assignee: Kabushiki Kaisha Toshiba, Kawasaki, Japan

[21] Appl. No.: 723,420

[22] Filed: Jun. 28, 1991

[30] Foreign Application Priority Data

| | | | |
|---|---|---|---|
| Jun. 29, 1990 | [JP] | Japan | 2-170274 |
| Jun. 29, 1990 | [JP] | Japan | 2-173070 |
| Nov. 28, 1990 | [JP] | Japan | 2-322572 |

[51] Int. Cl.[5] ..... G10K 11/16

[52] U.S. Cl. ..... 381/71; 381/94

[58] Field of Search ..... 381/71, 94

[56] References Cited

U.S. PATENT DOCUMENTS

| | | | |
|---|---|---|---|
| 4,677,677 | 6/1987 | Eriksson . | |
| 4,987,598 | 1/1991 | Eriksson | 381/71 |
| 5,018,202 | 5/1991 | Takahashi et al. | 381/71 |
| 5,022,082 | 6/1991 | Eriksson et al. | 381/71 |
| 5,029,218 | 7/1991 | Nagayusu | 381/71 |

FOREIGN PATENT DOCUMENTS

| | | |
|---|---|---|
| 59-133595 | 7/1984 | Japan . |
| 2069280 | 8/1981 | United Kingdom . |
| 2088951 | 6/1982 | United Kingdom . |

OTHER PUBLICATIONS

Journal of Sound and Vibration; C. F. Ross; 1982, vol. 80(3), pp. 381-388.

Soviet Physics: Acoustics, vol. 36, No. 3, May/Jun. 1990, pp. 276-279, G. S. Lyubashevskii, et al., "Rate of Convergence of Adaptive Suppression of Broadband Oscillations in One-Dimensional Structures".

"An Adaptive Digital Filter For Broadband Active Sound Control".

Proceedings of the Acoustical Society of Japan (Autumn Conference); H. Hamada; Oct., 1986, pp. 367-368; "Research of Electronic Sound Cancellation System (6th Report)".

*Primary Examiner*—Forester W. Isen

*Attorney, Agent, or Firm*—Oblon, Spivak, McClelland, Maier & Neustadt

[57] ABSTRACT

An adaptive type active noise cancellation apparatus comprises a first sensor for detecting a noise generated by a noise source and outputting a detection signal, a filter having a predetermined filter coefficient and filtering the output signal from the first sensor by using the predetermined filter coefficient and outputting a filtered signal, a speaker for receiving the filtered signal and generating a sound corresponding to the filtered signal, an active noise cancellation control system for actively canceling a noise at a control target point by using the sound generated by the speaker, a second sensor, arranged at the control target point, for detecting a sound at the control target point and outputting a detection signal, and an adaptive control system for receiving the output signals from the first and second sensors and adaptively updating the filter coefficient in accordance with a change in state of a system to which the active noise cancellation control system is applied. The adaptive control system includes a switch for stopping the active noise cancellation control system in adaptive processing, and a correction system for correcting the output signal from the first sensor or the second sensor by using a transfer function corresponding to a delay in a spatial system between the speaker and the second sensor and a delay required for calculation processing.

13 Claims, 10 Drawing Sheets

ADAPTIVE ACTIVE NOISE CANCELLATION APPARATUS

BACKGROUND OF THE INVENTION

1. Field of the Invention

The present invention relates to an adaptive active noise cancellation apparatus and, more particularly, an adaptive active noise cancellation apparatus including an adaptive control system capable of adaptively obtaining a filter coefficient used for an active noise cancellation control system in a state wherein a sound source is continuously driven.

2. Description of the Related Art

Recently, an active noise cancellation apparatus based on an acoustic control technique has been developed. In this active noise cancellation apparatus, in general, a noise generated by a primary noise source is detected by a sensor, and a sound generator such as speaker is operated in response to a signal obtained by filtering a signal from the sensor through a filter having a predetermined filter coefficient, thereby actively cancelling the noise at a control target point by a sound generated by the sound generator. The principle of such noise cancellation is disclosed in U.S. Pat. No. 2,043,416.

In such an active noise cancellation apparatus, a filter coefficient required for noise cancellation is obtained by using the principle of a digital filter. More specifically, if a transfer function in a spatial system is represented by $H(\omega)$; and a signal input to a space, $X(\omega)$, an output $Y(\omega)$ in a frequency region is given by $$Y(\omega)=H(\omega)\cdot X(\omega) \tag{1}$$

However, an output in a time domain is represented by convolution integration:

$$y(t) = \sum_{-\infty}^{\infty} h(\tau) \times (t-\tau)d\tau = h(t) * x(t) \tag{2}$$

where h(t) is the impulse response. In the embodiment, the frequency domain is represented by a large letter such as Y, H, X, S, G, M, L, E, etc., while the time domain is indicated by a small letter such as y, h, x, s, g, m, l, e, etc.

As is apparent from equation (2), the output represented by a product in the frequency region is obtained from the sum of products in the time domain, i.e., multiplying the impulse response and values obtained by sequentially delaying an input value in the time domain by $\tau$, and adding the resultant products together. That is, an operation equivalent to equation (1) can be realized by a product summation operation and a delay circuit having a delay time $\tau$. In an actual control operation or the like, the range of integration is finite, and a corresponding arithmetic operation is generally executed in a digital manner. Therefore, an equation corresponding to equation (2) is $$y(t_n) = \sum_{k=1}^{n} h(k)\cdot x(t_n-k) \tag{3}$$

This is generally called an FIR (Finite Impulse Response) filter. In equation (3), h(k) is the impulse response, i.e., the filter coefficient of this filter. In an active noise cancellation apparatus, an impulse response, i.e., a filter coefficient, used for noise cancellation control must be obtained in advance. A method of obtaining a filter coefficient will be described below with reference to FIG. 1. FIG. 1 shows a case wherein an active noise cancellation apparatus 4 prevents a noise generated by a noise source 2 housed in a duct 1 from leaking through an opening portion 3 of the duct 1. A sensor, e.g., an acceleration pickup 5 for detecting vibrations, detects a noise generated by the noise source 2 by using another signal having a high correlation with this noise. A filter coefficient required to constitute an FIR filter is set in a signal processor 6. A speaker 7 generates an active sound required for noise cancellation. An evaluation microphone 8 is arranged to evaluate a cancellation effect at a noise cancellation target point.

Assuming that a transfer function between the noise source 2 and the evaluation microphone 8 is represented by L; a transfer function between the speaker 7 and the evaluation microphone 8, M; and an noise signal generated by the noise source 2 (and detected by the acceleration pickup 5), S, a signal I observed by the evaluation microphone 8 is given by $$I=S\cdot L+S\cdot G\cdot M \tag{4}$$

where G is the transfer function required for noise cancellation. When the noise is completely canceled at the noise cancellation target point, the value I in equation (4) is given by I=0. Therefore, the transfer function G must be given by $$G=-L/M \tag{5}$$

Equation (5) is normally calculated by a fast Fourier transform in a frequency region. An impulse response is obtained by an inverse Fourier transform of the resulting value. The obtained impulse response is set in the signal processor 6 as a filter coefficient.

The active noise cancellation apparatus 4 having the above-described arrangement, however, cannot cope with a generated noise by using the fixed filter coefficient obtained from equation (5) when a transfer function in a spatial system for a space changes in quality over time, or the characteristics (e.g., correlation) of the noise source change.

In order to cope with the above inconvenience, therefore, an adaptive active noise cancellation apparatus using an adaptive control technique has recently been developed (disclosed in, e.g., "Study of Electronic Sound Cancellation System for Piping: Adaptive Type DSM System", Lecture Papers of Japanese Association of Acoustics, pp. 367–368). Adaptive type active noise cancellation apparatuses of various schemes are available. According to the most simple apparatus, the signal processor 6 functions as an adaptive controller and, for example, every time the output I from the evaluation microphone 8 exceeds a predetermined level, the transfer function G with which the output I from the evaluation microphone 8 is minimized is obtained, and the filter coefficient in the signal processor 6 is adaptively updated. That is, in this adaptive type active noise cancellation apparatus, when an active noise is output from the speaker 7 upon a multiplication of a signal S and a filter coefficient, the transfer function G with which a sound obtained by synthesizing the active sound and the noise sound from the noise source 2 becomes zero at the position of the evaluation microphone 8 is obtained, and an impulse response, i.e., a filter coefficient, is obtained from this transfer function G. In the adaptive type active noise cancellation apparatus having such an arrangement, since a filter coefficient can be adaptively obtained while a continuous operation of the noise source 2 is allowed, only few limitations are imposed on the noise source 2, and the overall arrangement of the apparatus can be simplified.

In the adaptive type active noise cancellation apparatus having the above-described arrangement, however, the following problems are posed. FIG. 2 shows an equivalent circuit diagram of an adaptive control system in the adaptive type active noise cancellation apparatus having the above arrangement. Referring to FIG. 2, reference symbol M denotes a transfer function between a speaker 7 and an evaluation microphone 8; L, a transfer function between the noise source 2 and the evaluation microphone 8; and e, an error signal observed by the evaluation microphone 8. The transfer function G is determined so as to set the error signal e to be zero. However, as is apparent from the arrangement shown in FIG. 2, since adaptive control is performed while the error signal e includes the influences of the transfer function M in the adaptive control system incorporated in the conventional apparatus, the adaptive control system does not operate to set the signal e to be zero. More specifically, one element, i.e., $g_{new,1}$, of a new filter coefficient $g_{new}$ (impulse response) obtained in the arrangement shown in FIG. 1 is given by $$g_{new,1} = g_1 - 2\mu\left(l^t \cdot s + g_1 \cdot \sum_i mi \cdot si + g_2 \cdot \sum_i mi \cdot S_{i+1} + g_3 \cdot \sum_i mi \cdot S_{i+2} + \ldots + g_n \cdot \sum_i mi \cdot S_{i+N-1}\right)\sum_i mi \cdot Si$$

where a small letter indicates a time domain, and a bold letter indicates a column vector. The apparatus shown in FIG. 1 does not execute calculations of $$\sum_i mi \cdot si.$$

For this reason, in the adaptive controller shown in FIG. 1, the filter coefficient cannot be converged to a desired value. Therefore, in the adaptive active noise cancellation apparatus incorporating the adaptive control system shown in FIG. 1, a good noise cancellation effect cannot be obtained. As described above, in the conventional adaptive active noise cancellation apparatus having the function of adaptively updating the filter coefficient in a state wherein continuous driving of a noise source is allowed, the convergence of the filter coefficient is interfered by the influences of the transfer function included in an error signal. Therefore, proper adaptive control cannot be realized.

SUMMARY OF THE INVENTION

It is an object of the present invention to provide an adaptive active noise cancellation apparatus which can adaptively update a filter coefficient while a noise source is continuously operated, and can perform adaptive control processing in a state wherein the influences, of a transfer function, included in an error signal are removed, thereby executing good noise cancellation control. An adaptive active noise cancellation apparatus according to the present invention incorporates an adaptive control system having a correction system for correcting an input signal by using a transfer function corresponding to a delay of a spatial system from a sound generator to a sensor for evaluation noise cancellation and a delay required for calculation processing. The correction system serves to remove the influences of the transfer function corresponding to the delay of the spatial system from the sound generator to the sensor for evaluating noise cancellation and the delay required for calculation processing in adaptive control processing. Therefore, proper adaptive control processing can be executed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

According to the basic features of the present invention, a transfer function required for noise cancellation is converged, i.e., the transfer function is set to be an optimal value, and a noise cancellation is performed by using the converged transfer function. These operations will be sequentially described below.

Figure 3:
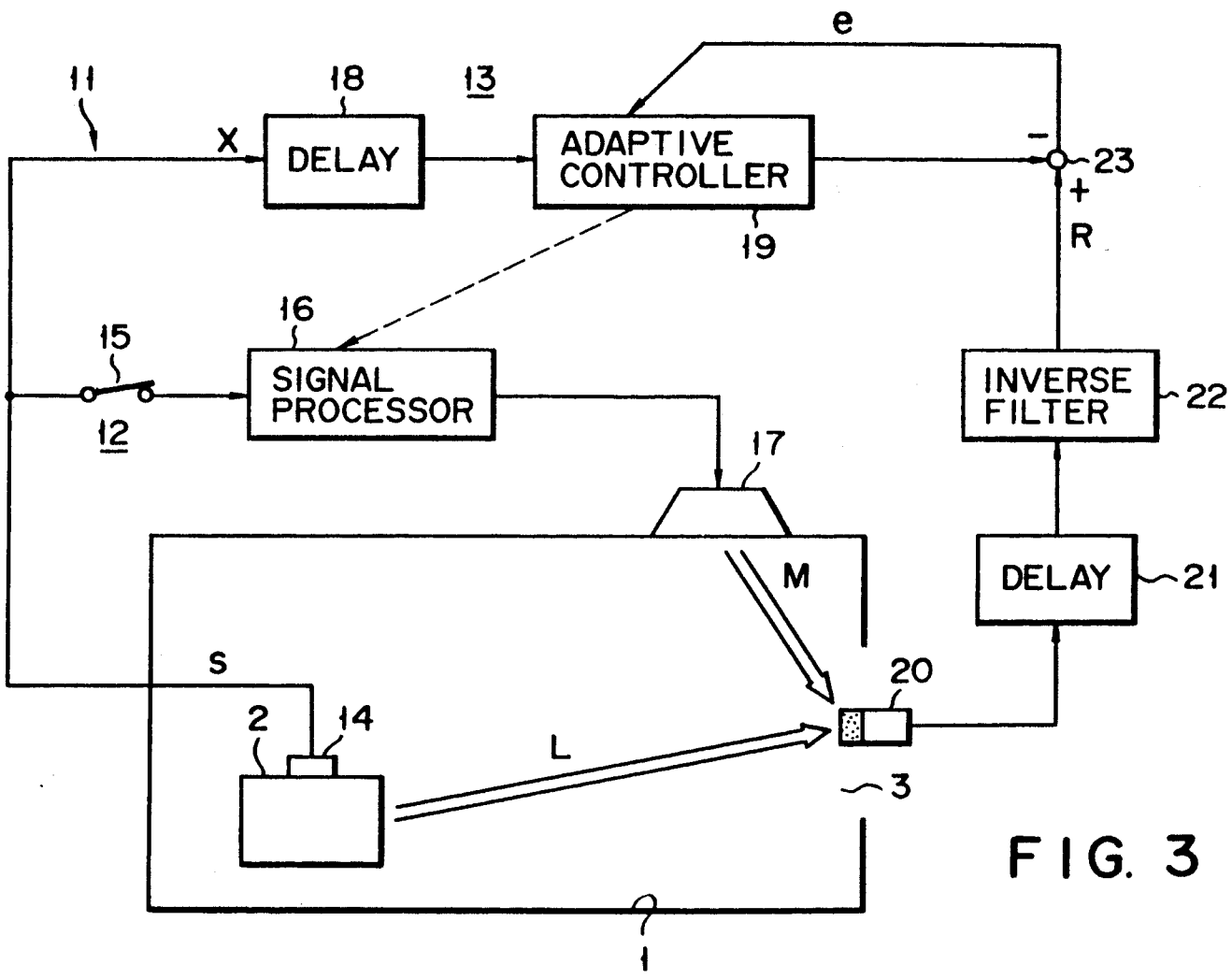
FIG. 3 is a block diagram showing an arrangement of an adaptive active noise cancellation apparatus according to an embodiment of the present invention.

FIG. 3 shows a case wherein an adaptive active noise cancellation apparatus 11 is used to prevent a noise generated by a noise source 2 housed in a duct 1 from leaking through an opening portion 3.

The adaptive active noise cancellation apparatus 11 comprises an active noise cancellation control system 12 and an adaptive control system 13 for adaptively updating the filter coefficient of the active noise cancellation control system 12. The active noise cancellation control system 12 comprises a sensor 14 constituted by, e.g., an acceleration pickup for detecting a signal having a high correlation with a noise generated by a noise source 2, e.g., vibrations of the noise source 2, a signal processor 16 for receiving an output signal S from the sensor 14 through a switch 15, and a speaker 17 to be driven by an output from the signal processor 16. The signal processor 16 is constituted by, e.g., an amplifier for amplifying the input signal S, an A/D converter for A/D-converting the signal S, an FIR filter receiving a digital signal, performing a convolution operation and having a predetermined filter coefficient, and a D/A converter for D/A-converting a signal filtered by the FIR filter.

The adaptive control system 13 comprises a delay unit 18 for outputting the output signal S from the sensor 14 with a delay of a predetermined period of time (T), an adaptive controller 19 for receiving a signal passing through the delay unit 18, an evaluation microphone 20 arranged at the opening portion 3 of the duct 1, a delay unit 21 for delaying an output from the evaluation microphone 20 by the predetermined period of time (T), a correction inverse filter 22 for multiplying a signal passing through the delay unit 21 by an inverse function $M^{-1}$ of a transfer function M (including a transfer function corresponding to a delay required for calculation processing) between the speaker 17 and the evaluation microphone 20, and outputting the resulting value, and an adder 23 for supplying the sum of an output R from the inverse filter 22 and an output from an adaptive filter of the adaptive controller 19, as an error signal e, to the adaptive controller 19.

The adaptive controller 19, the inverse filter 22, and the adder 23 are constituted by digital signal processing systems. In addition, the adaptive controller 19 is operated every time the error signal e exceeds a predetermined level. While the adaptive controller 19 is operated, the switch 15 is controlled to be OFF.

An operation of the adaptive active noise cancellation apparatus having the above-described arrangement will be described below.

In a normal operation, the switch 15 is turned on, and a noise at a control target point, i.e., at the position of the evaluation microphone 20, is kept to be minimized by the operation of the active noise cancellation system 12.

When the quality, state, and the like of the noise source 2 change, since the conditions required for noise cancellation are disturbed, a noise source exceeding a given level is observed at the position of the evaluation microphone 20. An output signal from the evaluation microphone 20 is supplied, as an error signal e, to the adaptive controller 19 through the delay unit 21, the inverse filter 22, and the adder 23. When the level of the error signal e exceeds a predetermined value, the switch 15 is turned off, and at the same time, the adaptive controller 19 starts to operate. Note that the delay units 18 and 21 serve to compensate for a delay caused by the inverse filter 22.

The adaptive controller 19 performs the following arithmetic operation using an input signal X received through the delay unit 18, the error signal e received through the adder 23, and a filter coefficient G set in the adaptive controller 19:

$$E=L\cdot M^{-1}\cdot X\cdot D-X\cdot D\cdot G \tag{6}$$

where D is the transfer function of the delay units 18 and 21, and X is a value corresponding to the output signal S from the sensor 14.

The adaptive controller 19 adjusts the internal filter coefficient G to set the value e in equation (6), i.e., the error signal e, to be zero. That is, the controller 19 converges the filter coefficient G. Therefore, a filter coefficient is calculated as follows:

$$G=(L\cdot M^{-1}\cdot D)/D=L\cdot M^{-1} \tag{7}$$

Subsequently, noise cancellation is performed by active control using the filter coefficient G converged in the above-described manner. In this case, the converged filter coefficient G (obtained by adding a sign "−" to the equation (7)) is transferred to the signal processor 16, and the filter coefficient of the signal processor is replaced with the new filter coefficient. After the filter coefficient is updated, the switch 15 is turned on to perform normal active noise cancellation control. That is, the signal processor 16 outputs a noise cancellation signal corresponding to the updated filter coefficient G to the speaker 17. With this operation, the speaker 17 generates a sound having a phase opposite to that of the noise generated by the noise source 2, thus performing noise cancellation.

According to the above embodiment, since the inverse filter 22 having the inverse function $M^{-1}$ of the transfer function M between the speaker 17 and the evaluation microphone 20 is inserted in the output signal path of the evaluation microphone 20, the influences, of the transfer function M, which are included in an output signal from the evaluation microphone 20 are corrected by the inverse filter 22. Therefore, when the adaptive control system 13 executes processing, i.e., convergence of the filter coefficient G, the influences of the transfer function M can be removed, leading to proper adaptive control processing. As a result, the filter coefficient of the active noise cancellation control system 12 can be optimized in accordance with a change in transfer function L, thus performing a proper noise cancellation operation.

Figure 4:
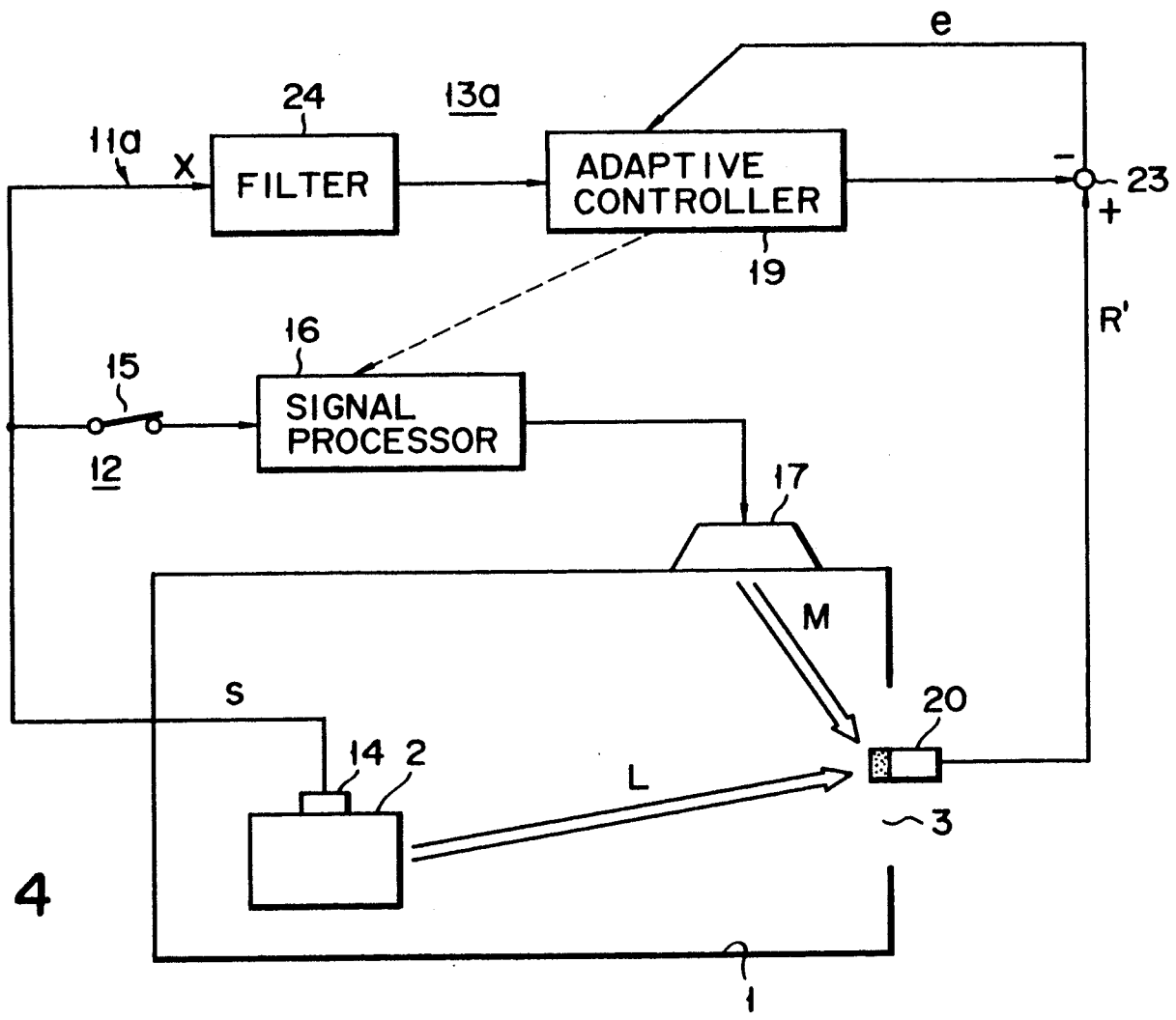
FIG. 4 is a block diagram showing an adaptive active noise cancellation apparatus according to another embodiment of the present invention.

FIG. 4 shows an adaptive active noise cancellation apparatus 11*a* according to another embodiment of the present invention. The same reference numerals in FIG. 4 denote the same parts as in FIG. 3, and a detailed description thereof will be omitted.

The adaptive type active sound cancellation apparatus according to this embodiment differs from that shown in FIG. 3 in respect of the arrangement of an adaptive control system 13*a*.

More specifically, in this embodiment, an output signal S from a sensor 14 is input to an adaptive controller 19 through a forward filter 24 used for a correcting operation. An output signal R′ from an evaluation microphone 20 is directly supplied to an adder 23. The forward filter 24 is set to have a transfer function M (including a transfer function corresponding to a delay required for calculation processing, in practice) between a speaker 17 and the evaluation microphone 20. With this arrangement, an error signal e input to the adaptive controller 19 is given by $$E=X\cdot L-X\cdot M\cdot G \quad (8)$$

The adaptive controller 19 converges an internal filter coefficient G so as to set the error signal e to be zero. Therefore, a filter coefficient is calculated as follows:

$$G=L/M \quad (9)$$

The filter coefficient obtained by adding a sign "−" to equation (9) in this manner is set in a signal processor 16. Similar to the above-described embodiment, therefore, when the adaptive control system 13*a* executes processing, i.e., convergence of the filter coefficient, the influences of the transfer function M can be removed, thus realizing proper adaptive control processing. In this case, the inverse filter coefficient $M^{-1}$ need not be obtained, and hence there is no need to set a delay element for maintaining the casualty of the filter having the inverse filter coefficient $M^{-1}$. Therefore, the arrangement of the apparatus can be simplified.

Figure 5:
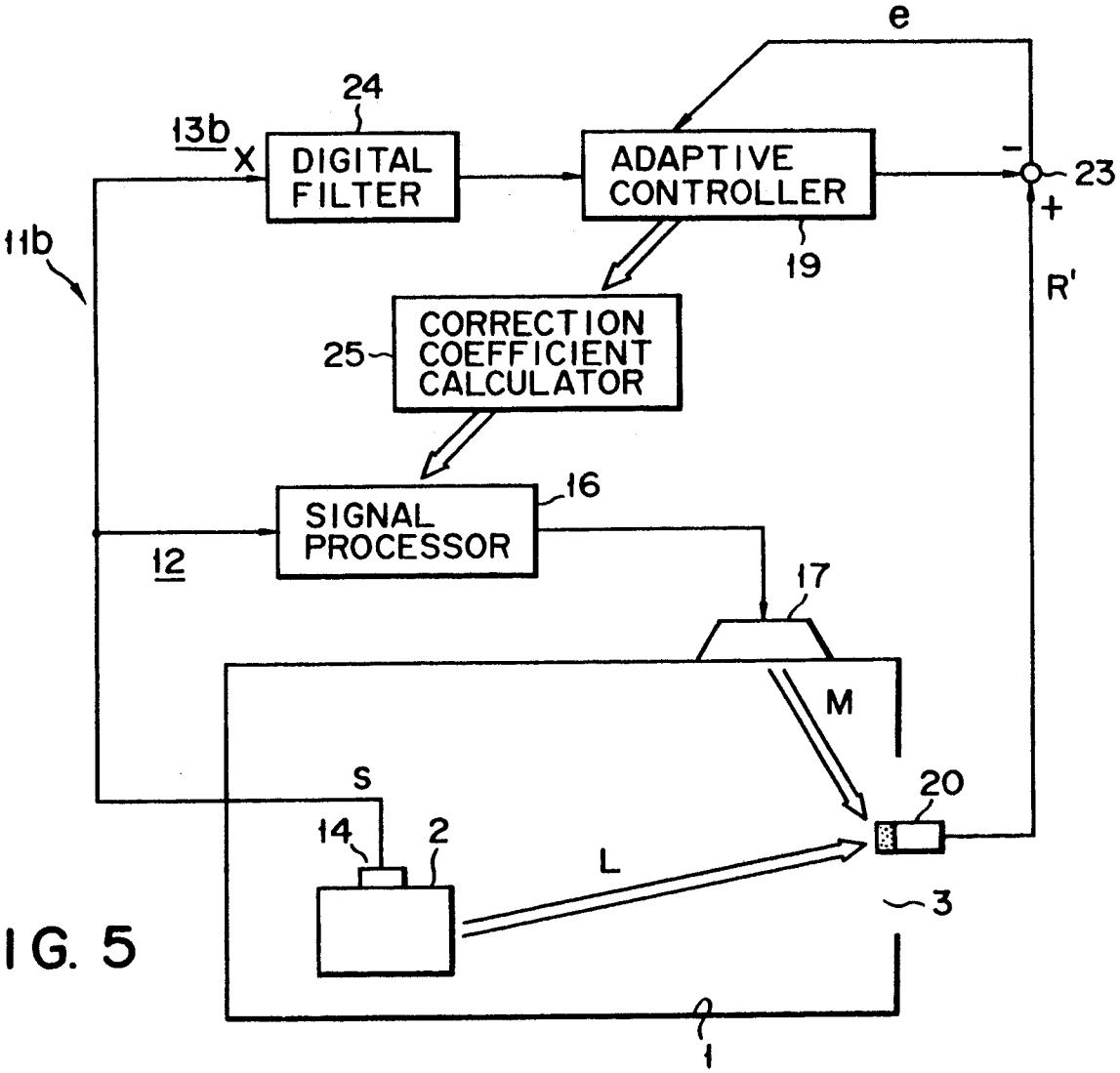
FIG. 5 is a block diagram showing an arrangement of an adaptive active noise cancellation apparatus according to still another embodiment of the present invention.

FIG. 5 shows an adaptive active noise cancellation apparatus according to still another embodiment of the present invention, which is especially applied to an electric refrigerator.

In the above embodiment, adaptive control, i.e., convergence of a filter coefficient, and active control, i.e., active noise cancellation, are alternately performed. In this embodiment, however, convergence of a filter coefficient G is performed by an adaptive control system 13*b* while an active noise cancellation control system 12 continuously performs a noise cancellation operation.

More specifically, in this embodiment, while a noise cancellation operation is performed in accordance with the filter coefficient G set in a signal processor 16, an adaptive controller 19 obtains a filter coefficient G′ required to cancel a noise component which cannot be canceled by the present filter coefficient G. A correction coefficient calculator 25 is arranged in this embodiment at a position corresponding to a position between the adaptive controller 19 and the signal processor 16 in the embodiment shown in FIG. 5. The calculator 25 obtains a new filter coefficient by adding the filter coefficient G′ obtained by the adaptive controller 19 to the filter coefficient G currently set in the signal processor 16, and sets the new filter coefficient in the signal processor 16.

If the filter coefficient currently set in the signal processor 16 is represented by G; and the filter coefficient set in the adaptive controller 19, G′, an error signal e input to the adaptive controller 19 is given by $$E=(X\cdot M\cdot G+X\cdot L)-X\cdot M\cdot G' \quad (10)$$

The adaptive controller 19 converges the filter coefficient G′ so as to set the error signal e to be zero. Therefore, the filter coefficient G′ set in the adaptive controller 19 after the adjustment is represented by $$G'=L/M+G=L/M-(L/M)_{old} \quad (11)$$

G is the coefficient currently set in the signal processor 16, and L/M is the filter coefficient newly obtained in accordance with a change in state of the system. The value $-(L/M)_{old}$ is equivalent to the present filter coefficient. The value G′ obtained by equation (11) represents an error, of the filter coefficient G, which is obtained on the basis of an error, at the noise cancellation target point, caused by a change in state or the like of the active noise cancellation control system 12 while noise cancellation is performed in accordance with the filter coefficient G set in the signal processor 16. Therefore, in order to cope with a change in state of the active noise cancellation control system 12, it is only required that the filter coefficient G set in the signal processor 16 be replaced with a new filter coefficient $G_{new}$ given by $$G_{new}=-L/M=G-G' \quad (12)$$

The correction coefficient calculator 25 serves to calculate equation (12) and set the new filter coefficient $G_{new}$ in the signal processor 16.

With the above-described arrangement, while noise cancellation is executed by the active noise cancellation control system 12, a noise component which could not be canceled in a previous operation is detected, and the filter coefficient can be quickly updated in a direction to obtain a better sound cancellation effect. Even if, therefore, the state of the active noise cancellation control system 12 changes, a proper noise cancellation operation can be performed.

Figure 6:
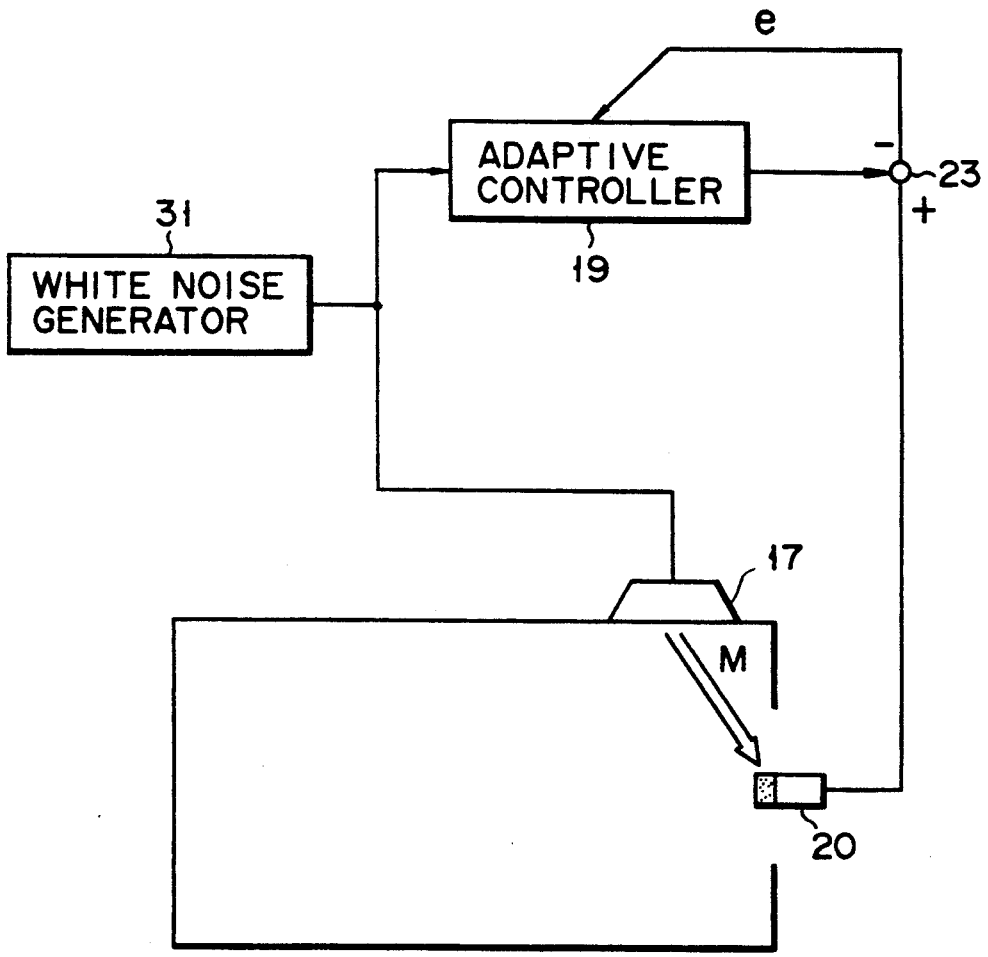
FIG. 6 is a circuit diagram showing an arrangement for obtaining a filter coefficient set for a filter in the embodiment shown in FIG. 5.

A method of obtaining a transfer function M used to obtain the new filter coefficient $G_{new}$ and set in the forward filter 24 in the embodiment shown in FIG. 5 will be described below. In the first step, as shown in FIG. 6, a white noise signal is supplied from a white noise generator 31 to a speaker 17 and the adaptive controller 19. As a result, an evaluation microphone 20 outputs a signal corresponding to the transfer function M between the speaker 17 and the microphone 20. This signal is input to the adaptive controller 19 through an adder 23. The adaptive controller 19 calculates the transfer function M on the basis of the white noise signal from the white noise generator 31 and the error signal e from the adder 23, and identifies the transfer function M as a filter coefficient. In the second step, the white noise generator 31 is turned off, and the filter coefficient (M) obtained in the above-described manner is transferred from the adaptive controller 19 to the digital filter 24. At this time, "0" is set, as an initial value, in the signal processor 16. In the third step, a noise source 2 is energized, and a signal S is input to the filter 24 and the signal processor 16. This signal S is input to the adaptive controller 19 through the filter 24 in which the filter coefficient M is set. Meanwhile, the adaptive controller 19 performs an arithmetic operation upon reception of the input signal from the filter 24. When the error signal e converges, a filter coefficient G=(L/M) obtained at this time is inverted and transferred to the signal processor 16. This operation is equivalent to setting of G=G−G′ in the signal processor 16. In the fourth step, the adaptive controller 19 executes an adaptive operation by using the filter coefficient obtained in the third step. At this time, the coefficient G′ identified by the adaptive controller 19 is represented by the following equation:

$$G'=L/M+G=L/M+(-L/M)_{old}$$

This equation is used to obtain an error between a coefficient G currently set in the signal processor 16 and a true filter coefficient L/M.

In the fifth step, the correction coefficient calculator 25 calculates $(-L/M)=G-G'$, and transfers the new filter coefficient G as the new filter coefficient to the signal processor 16. Subsequently, the steps 4 and 5 are repeated until the filter coefficient converges.

Figure 7:
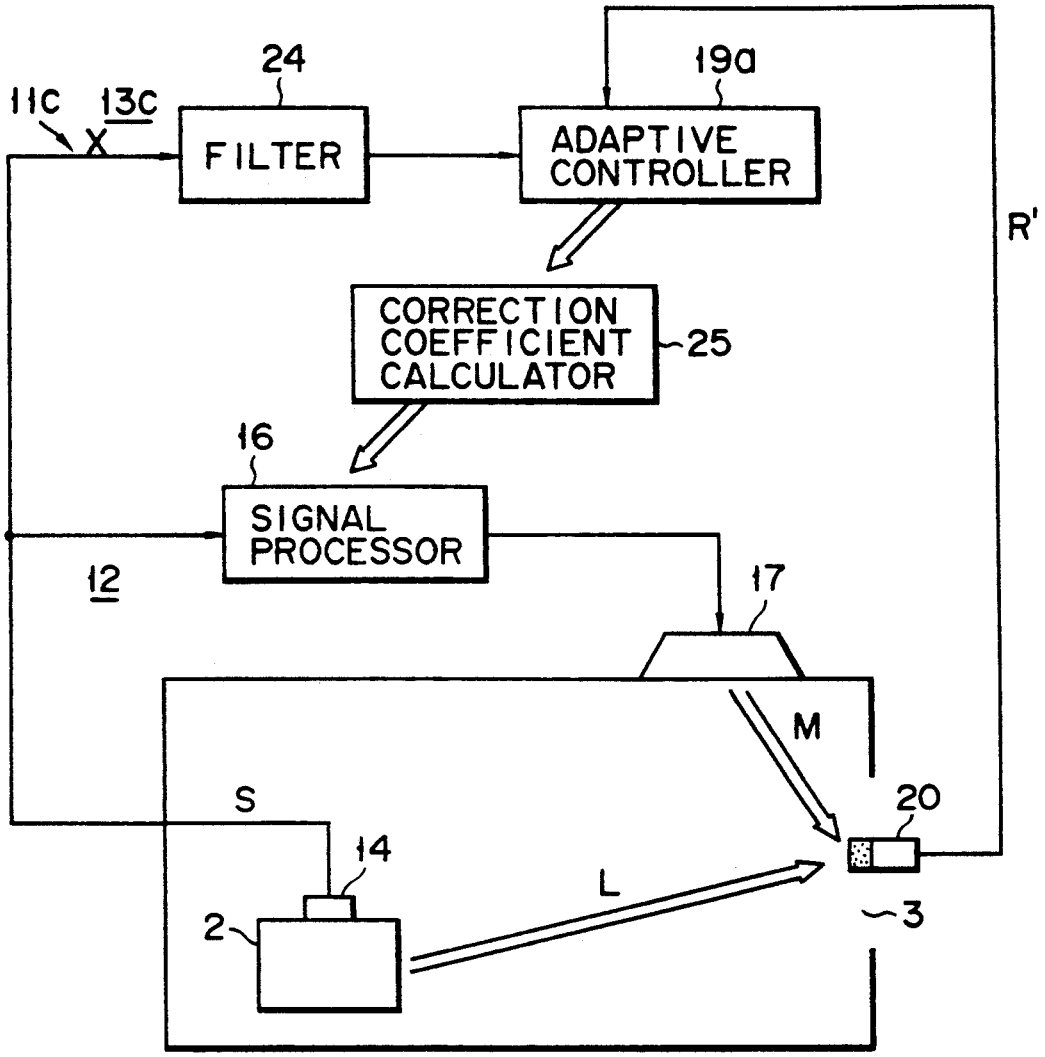
FIG. 7 is a block diagram showing an adaptive active noise cancellation apparatus according to still another embodiment of the present invention.

FIG. 7 shows an adaptive active noise cancellation apparatus 11c according to still another embodiment of the present invention. The same reference numerals in FIG. 7 denote the same parts as in FIG. 5, and a detailed description thereof will be omitted.

The adaptive active noise cancellation apparatus 11c of this embodiment differs from that shown in FIG. 5 in that an output signal R' from an evaluation microphone 20 is directly supplied, as an error signal, to an adaptive controller 19a. In this embodiment, since an adaptive filter output need not be externally output from the adaptive controller 19a, the arrangement of the controller 19a can be simplified.

A filter coefficient $h_{new}$ is updated by the new adaptive controller 19a according to the following equations:

$$h_{new}=h_{old}+\mu ex \quad (13)$$

$$e=d-h_{old}^t\cdot x \quad (14)$$

In the embodiments shown in FIGS. 3 to 5, the value e is obtained by the adder 23. In the embodiment shown in FIG. 7, however, the value e is spatially calculated. That is, the value e is obtained from a sound a from an active speaker 17 and a noise b from a noise source 2 as follows:

$$e=a+b \quad (15)$$

Since the value e is required to be zero in active control, equation (15) is equivalent to setting the value e to be zero in equation (14). When e in equation (13) is substituted by equation (15), the value h for setting the value e to be zero, i.e., a filter coefficient used for noise cancellation can be obtained.

Note that if a correction coefficient calculator 25 is also arranged between the adaptive controller 19 and the signal processor 16 and the switch 15 is omitted in the embodiment shown in FIG. 3, the same control processing can be realized as in the embodiment shown in FIG. 5 or 7. According to the above-described embodiments, adaptive control processing can be performed while continuous driving of a noise source is allowed and the influences, of a transfer system, included in an error signal are taken into consideration. Therefore, effective adaptive control processing can be executed to improve the noise cancellation effect.

Figure 8:
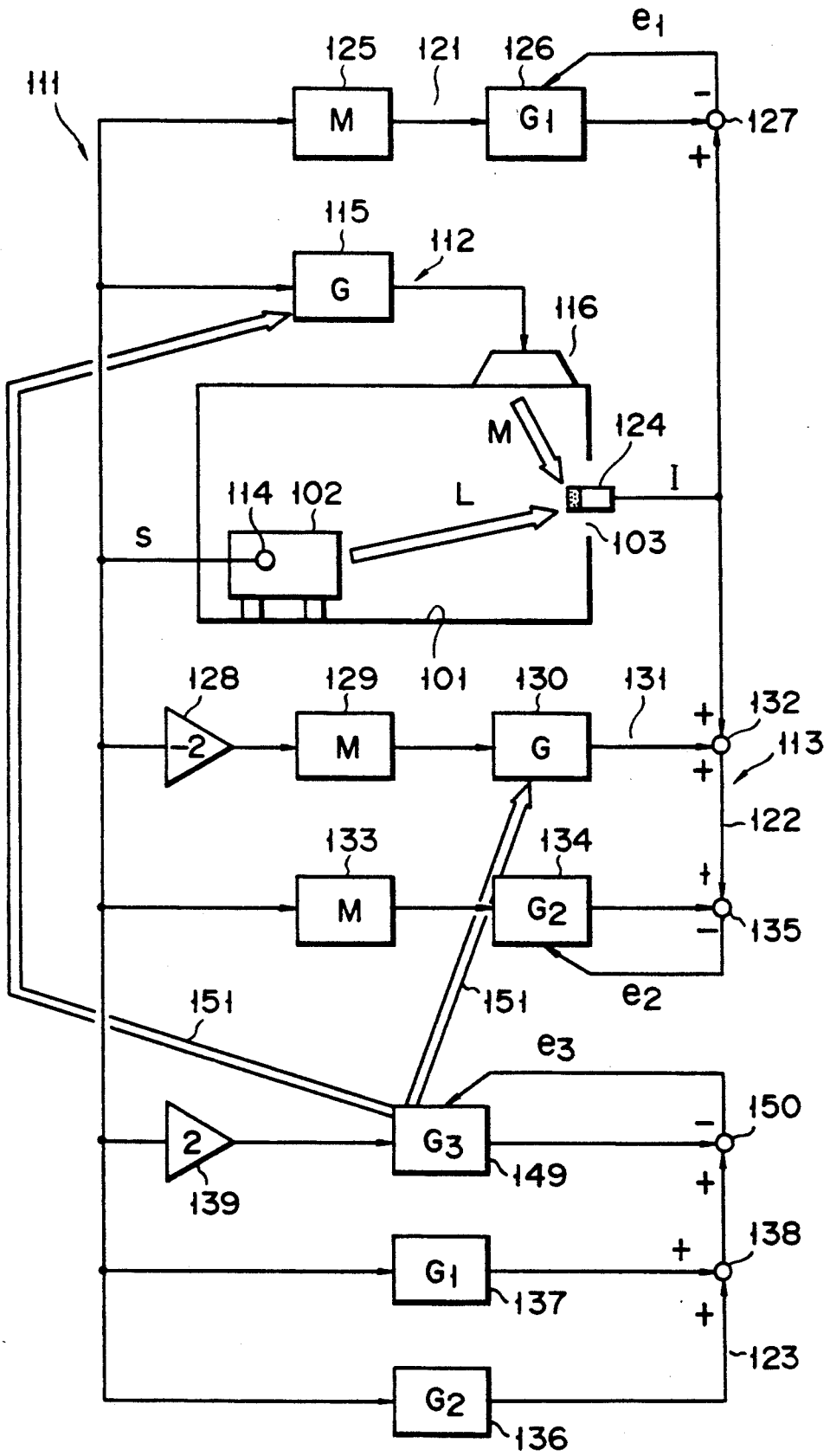
FIG. 8 is a block diagram showing an adaptive active noise cancellation apparatus according to still another embodiment of the present invention.

Still another embodiment of the present invention will be described with reference to FIG. 8. Similar to the above embodiments, in this embodiment, an adaptive active noise cancellation apparatus 111 is used to prevent a noise generated by a noise source 102 housed in a duct 101 from leaking through an opening portion 103.

The adaptive active noise cancellation apparatus 111 is mainly constituted by an active noise cancellation control system 112 and an adaptive control system 113 for adaptively updating the filter coefficient of the active noise cancellation control system 112. The active noise cancellation control system 112 comprises: a sensor 114 constituted by, e.g., an acceleration pickup for detecting another signal having a high correlation in respect with a noise, for example, vibrations caused by the noise source 102; a signal processor 115 for amplifying an output signal S from the sensor 114, A/D-converting the signal S, filtering the resulting signal by using an FIR filter with a predetermined filter coefficient G, D/A-converting the signal filtered by the FIR filter, and outputting the result signal; and a speaker 116 to be driven by an output from the signal processor 115.

The adaptive control system 113 comprises a first adaptive control system 121, a second adaptive control system 122, and an update control system 123.

The first adaptive control system 121 is constituted by a forward filter 125, having a filter coefficient corresponding to a transfer function M between the speaker 116 and an evaluation microphone 124 set at a control target point, for filtering the output signal S from the sensor 114, an adaptive controller 126 for receiving the output signal S filtered by the forward filter 125, and an adder 127 for adding an output signal I from the evaluation microphone 124 to a filter output from the adaptive controller 126, and supplying the sum signal as an error signal $e_1$ to the adaptive controller 126. The adaptive controller 126 adjusts a filter coefficient $G_1$ of the internal FIR filter so as to minimize the error signal $e_1$. That is, the error signal $E_1$ is represented by $$E_1=(S\cdot G\cdot M+S\cdot L)-S\cdot M\cdot G_1$$

Since $E_1=0$, $G_1$ is adjusted as follows:

$$\begin{aligned} G_1 &= (S\cdot G\cdot M+S\cdot L)/S\cdot M \\ &= G+L/M \\ &= G-G_{new}(G_{new}=-L/M) \end{aligned} \quad (16)$$

where L is the filter coefficient corresponding to a transfer function between the noise source 102 and the evaluation microphone 124, G is the filter coefficient currently set in the signal processor 115, and $G_{new}$ is the new filter coefficient to be set in the signal processor 115 in accordance with a change in state of the system. In the adaptive controller 126, therefore, the difference between the filter coefficient G currently set in the signal processor 115 and the new filter coefficient $G_{new}$ to be set in the signal processor 115 is obtained as the filter coefficient $G_1$.

The second adaptive control system 122 comprises: a series system 131 which is constituted by an inverting amplifier 128 for amplifying an input signal twofold and inverting its sign, a forward filter 129 having a filter coefficient corresponding to the transfer function M, and a filter 130 having a filter coefficient equal to the filter coefficient G currently set in the signal processor 115, and is designed to cause the output signal S from the sensor 114 to quentially pass through the respective components in the order named; an adder 132 for adding the output signal S from the sensor 114, which passes through the series system 131, to the output signal I from the evaluation microphone 124; a forward filter 133, having a filter coefficient corresponding to the transfer function M, for filtering the output signal S from the sensor 114; an adaptive controller 134 for receiving the output signal S filtered by the forward filter 133 as an input signal; and an adder 135 for adding the output from the adder 132 to the filter output from the adaptive controller 134, and supplying the sum signal as an error signal e2 to the adaptive controller 134.

The adaptive controller 134 adjusts the filter coefficient G of the internal FIR filter so as to minimize the error signal e2. That is, the error signal e2 is represented by $$E_2 = S \cdot G \cdot M + S \cdot L + (-2) \cdot S \cdot M \cdot G - S \cdot M \cdot G_2$$

Since $E_2 = 0$, the filter coefficient $G_2$ is given by $$\begin{aligned} G_2 &= (-S \cdot G \cdot M + S \cdot L)/S \cdot M \\ &= L/M - G \\ &= G + G_{new} \end{aligned} \quad (17)$$

where G is the filter coefficient currently set in the signal processor 115, and $G_{new}$ is the new filter coefficient to be set in the signal processor 115 in accordance with a change in state of the system. In the adaptive controller 134, therefore, the filter coefficient $G_2$ is obtained by multiplying a value $-1$ by the sum of the filter coefficient G currently set in the signal processor 115 and the new filter coefficient $G_{new}$ to be new set in the signal processor 115.

The update control system 123 comprises a filter 136 having the filter coefficient $G_2$ equal to the filter coefficient obtained by the adaptive controller 134, a filter 137 having the filter coefficient $G_1$ equal to the filter coefficient obtained by the adaptive controller 126, an adder 138 for adding the output signal S filtered by the filter 136 to the output signal S filtered by the filter 137, an amplifier 139 for amplifying the output signal twofold, an adaptive controller 149 for receiving an output signal from the inverting amplifier 139 as an input signal, an adder 150 for adding an output signal from the adder 138 to a filter output from the adaptive controller 149 and supplying the sum signal as an error signal e3 to the adaptive controller 149, and a coefficient transfer unit 151 for updating the filter coefficient of the signal processor 115 by using the filter coefficient G3 obtained by the adaptive controller 149 and replacing the filter coefficient of the filter 130 with the filter coefficient G3. Note that the filter coefficients G2 and G1 obtained by the adaptive controllers 134 and 126 are respectively transferred to the filters 136 and 137 by a coefficient transfer unit (not shown) at a predetermined time interval.

The adaptive controller 149 adjusts the filter coefficient G3 of the internal FIR filter so as to minimize the error signal e3. That is, the error signal e3 is represented by $$\begin{aligned} E_3 &= 2 \cdot S \cdot G_3 + (S \cdot G_1 + S \cdot G_2) \\ &= 2 \cdot S \cdot G_3 + S(G - G_{new}) + S(-(G + G_{new})) \\ &= 2 \cdot S \cdot G_3 - 2 \cdot S \cdot G_{new} \end{aligned}$$

Since $E_3 = 0'$, the filter coefficient $G_3$ is given by $$G_3 = G_{new} \quad (18)$$

This filter coefficient $G_3$, i.e., the filter coefficient $G_{new}$, is directly transferred to the signal processor 115 and the filter 130 by the coefficient transfer unit 151. Therefore, the FIR filter of the signal processor 115 processes signals by using the filter coefficient $G_{new}$ until a new filter coefficient new is transferred.

In the above-described arrangement, since the forward filters 125, 129, and 133 are arranged to compensate for the transfer function M between the speaker 116 and the evaluation microphone 124, the influences of the transfer function M, which pose a problem when an adaptive operation is executed while active noise cancellation control is performed, can be removed, thus realizing proper adaptive control. In addition, as is apparent from equation (18), the filter coefficient $G_3 = G_{new}$ to be newly set in the signal new processor 115 is directly obtained by using the adaptive controller 149 arranged in the update control system 123. Therefore, it is only required that the obtained filter coefficient $G_3$ be transferred to the signal processor 115 to replace the filter coefficient of the signal processor 115 with the new filter coefficient $G_3$. That is, this arrangement requires no complicated calculations for obtaining the new filter coefficient $G_3$, which are easily influenced by noise. Therefore, an optimal filter coefficient can be set in the active sound cancellation control system 112 in accordance with a change in state of the system so as to realize proper sound cancellation control.

Figure 9:
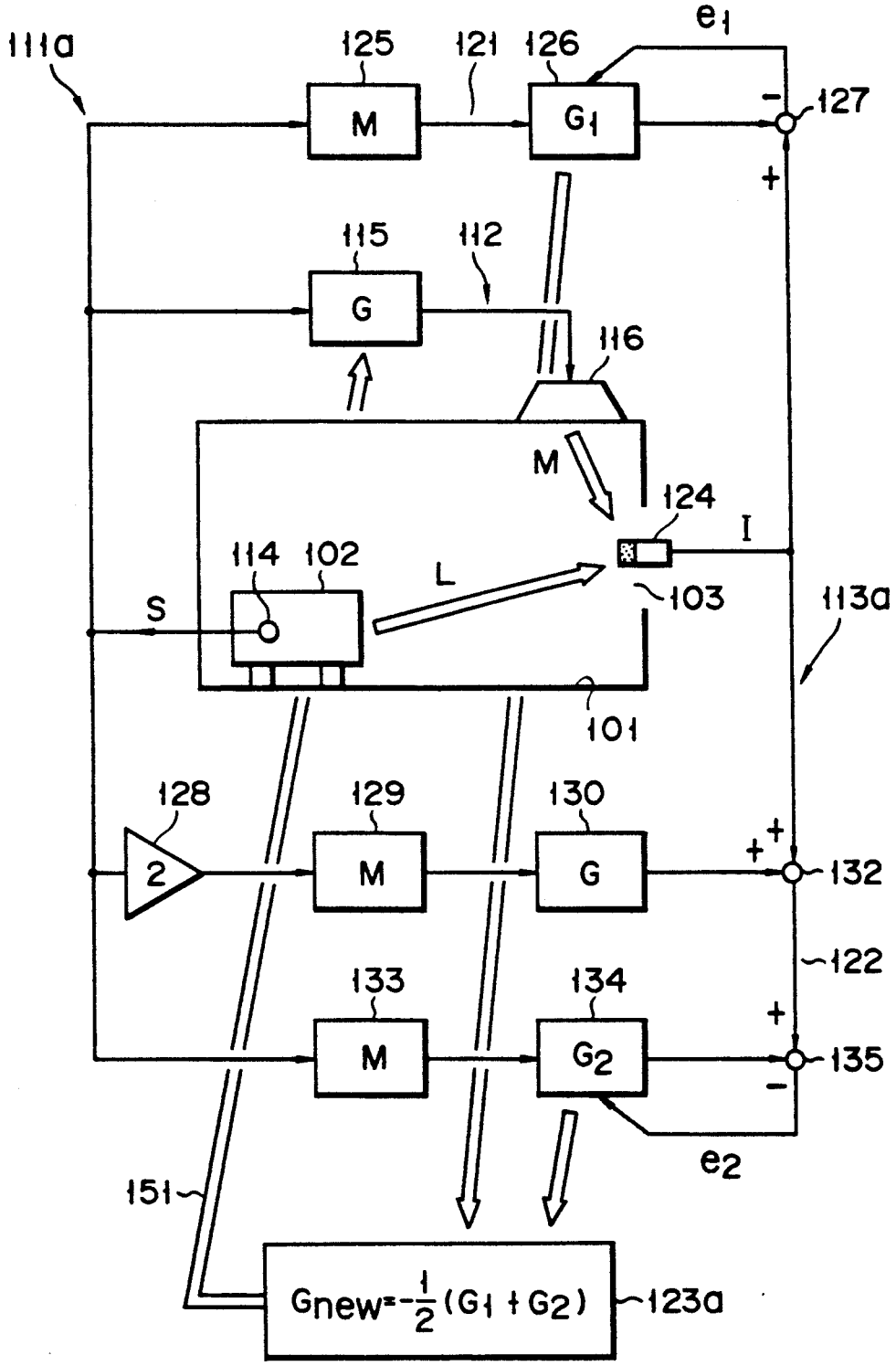
FIG. 9 is a block diagram showing an arrangement of an adaptive active noise cancellation apparatus according to still another embodiment of the present invention.

The present invention is not limited to the above-described embodiments. In the above embodiment, the adaptive controller is incorporated in the update control system 123. However, as shown in FIG. 9, an update control system 123a may be used to add a filter coefficient $G_1$ obtained by an adaptive controller 126 to a filter coefficient $G_2$ obtained by an adaptive controller 134 and multiply the resulting value by a gain of $-\frac{1}{2}$, thus outputting the resulting value as a new filter coefficient $G_{new}$. In this case, unlike the above embodiment, a new filter coefficient G cannot be directly obtained, but can be obtained by a simple means of addition. This contributes to a simplification of the arrangement.

According to the embodiments described above, in the process of active sound cancellation control, a filter coefficient required for the active cancellation control can be easily obtained with high precision without being influenced by a transfer system. Therefore, a good sound cancellation effect can be obtained.

Figure 10:
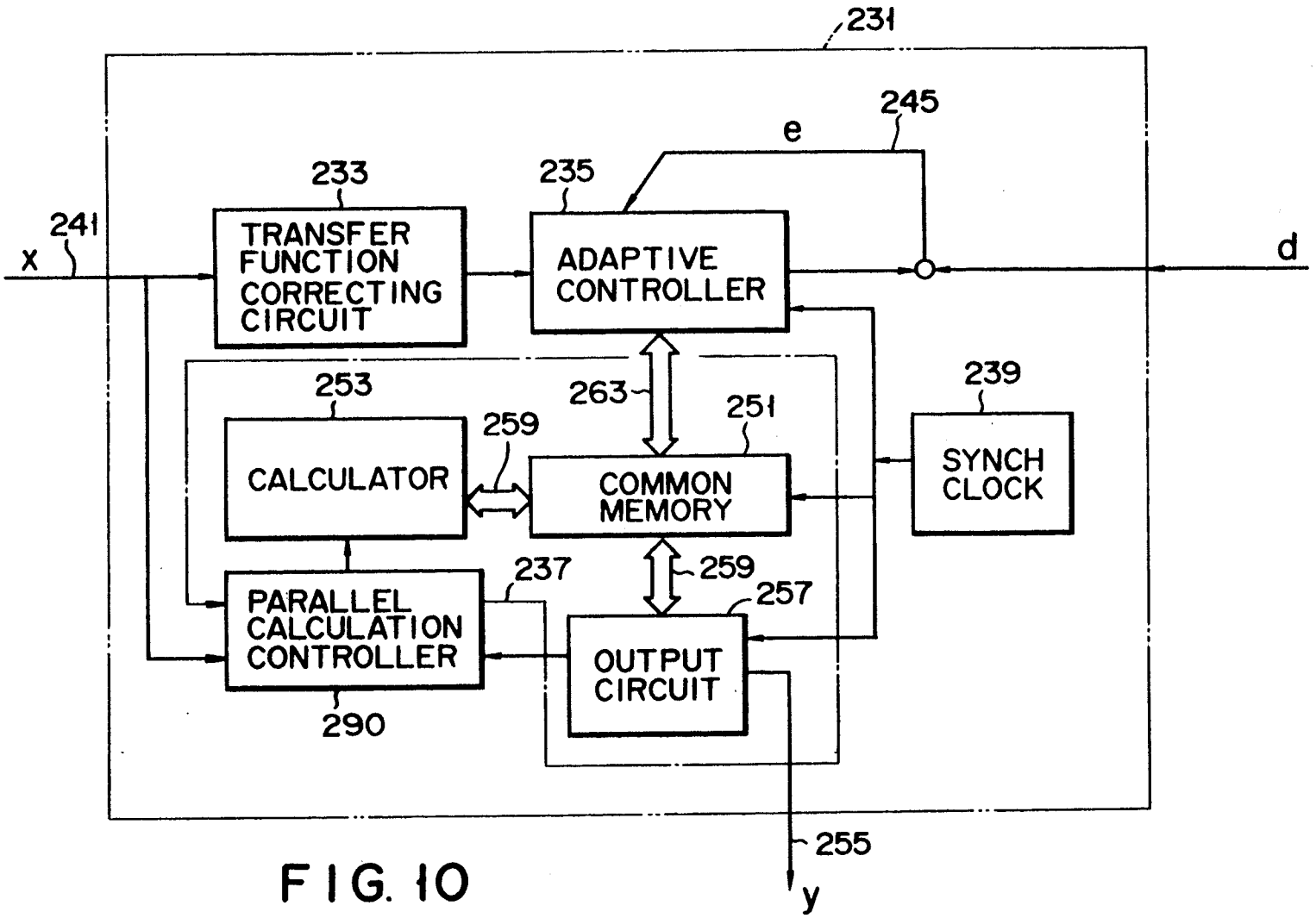
FIG. 10 is a block diagram showing an arrangement of an adaptive control apparatus according to still another embodiment of the present invention.

In the embodiment shown in FIG. 5, in addition to the adaptive controller 19, the correction coefficient calculator 25 is required to supply a filter coefficient obtained by the adaptive controller 19 to the signal processor 16. Furthermore, when the filter coefficient is to be transferred to the signal processor 16, transfer operations must be performed a number of times corresponding to the number of taps of the adaptive controller 19 (e.g., 128 transfer operations for a digital filter having 128 taps). Since such transfer operations cannot be performed simultaneously with noise cancellation, the filter coefficient must be transferred after a noise cancellation output is temporarily disabled. For this reason, a noise cancellation operation cannot be executed while an automatically updated filter coefficient is transferred to the signal processor 16. FIG. 10 shows an embodiment in which such drawback is overcome.

According to the embodiment shown in FIG. 10, an adaptive control apparatus 231 comprises a transfer function correcting circuit 233, an adaptive controller 235, a calculation/storage/output circuit 237, and a sync clock generator 239. The adaptive controller 235 is connected to the calculation/storage/output circuit 237 through a common bus 263.

An impulse response function is set in the transfer function correcting circuit 233. The circuit 233 performs filter processing of an input signal X input from an input terminal 241, i.e., convolution integration of the input signal X, and outputs the convolution integration result to the adaptive controller 235.

An algorithm represented by equation (19) is set in the adaptive controller 235:

$$W_{k+1} = W_k + 2\mu eX \tag{19}$$

where $W_k$ is the filter coefficient (impulse response function in time k), X is the input signal, $\mu$ is the convergence coefficient (associated with a convergence time or a converged value), and e is an error signal. The adaptive controller 235, in which equation (19) is set, receives an error signal e based on the difference between an output signal from the controller 235 and a desired signal d.

The calculation/storage/output circuit 237 is constituted by a common memory 251 for receiving an output (automatically set and updated filter coefficient) from the adaptive controller 235, a calculator 253, and an output circuit 257 for outputting an output signal from an output terminal 255. These components are connected to each other through a common bus 259.

An impulse response function to be used in the adaptive controller 235 and the output circuit 257 is set in the common memory 251. In this case, the impulse response function set in the adaptive controller 235 and that used by the output circuit 257 to perform a digital filtering operation of an input signal so as to obtain an output signal 255 are common to each other.

The sync clock generator 239 outputs a sync clock to the adaptive controller 235 and the output circuit 257. A filter coefficient obtained in accordance with this sync clock is simultaneously used as a common filter coefficient by the output circuit 257. With this operation, the output signal 255 can be obtained in real time.

The calculator 253 performs an arithmetic operation, e.g., calculating the sum of and the difference between the impulse response function obtained by the adaptive controller 235 and the previous impulse response function, thus processing the contents of the common memory 251 in accordance with an application. Since this arithmetic operation cannot be executed simultaneously with adaptive control, a delay is inevitably caused in the system.

Figure 11:
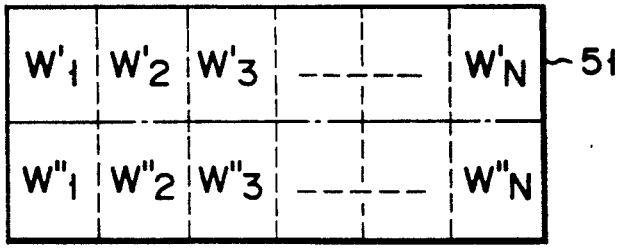
FIG. 11 is a view showing the contents of a common memory.

The common memory 251 is connected to the calculator 253 and the output circuit 257 through the common bus 259 so as to receive/transfer an impulse response function as common data therebetween. As schematically shown in FIG. 11, filter coefficients are stored in the common memory 251. More specifically, the common memory 251 has a first storage area for storing filter coefficients $W'_N$ and a second storage area for storing filter coefficients $W''_N$ of the output circuit 257. For example, in arithmetic processing, in response to one clock from the sync clock generator 239, the calculator 253 sets coefficients obtained by parallel processing, as new filter coefficients, in the common memory 251 in order to calculate the following equation (20) at high speed:

$$\begin{aligned} W_{1''} &= W_{1''} - W_{1'} \\ W_{2''} &= W_{2''} - W_{2'} \\ &\vdots \\ W_{N''} &= W_{N''} - W_{N'} \end{aligned} \tag{20}$$

As is apparent from equation (19), in an algorithm of the LMS, N filter coefficients can be simultaneously updated. Therefore, when equation (19) is calculated in the first start pulse, N new coefficients $W_{1'}$, i.e., $W_{1'}$, $W_{2'}$. . . $W_{N'}$ are obtained. In the second start pulse, operations of equation (20) are parallelly executed. In this case, since the respective variables are independent of each other, this parallel processing can be performed without any problem. The resulting values are stored at addresses $W_{i''}$ of the common memory 251. As a result, the previous coefficients $W_{i''}$ are instantly erased. Since these coefficients $W_{i''}$ are filter coefficients exclusively used for an output operation, output values directly reflect the results of the digital filtering processing. Therefore, the filter coefficients $W_{i''}$ used to calculate equation (19) may be directly used.

An adaptive control method by means of the adaptive control apparatus having the above-described arrangement will be described below. When an input signal x is input, the input signal passes through the transfer function correcting circuit 233 for correcting the difference between a transfer function between a device (not shown) to be adaptively controlled by an output signal y and an adaptive control evaluation point (not shown) and a transfer function associated with the input signal x. Thereafter, an error signal 245 based on the difference between the input signal x and a desired signal is obtained by an adder 249 The adaptive controller 235 automatically sets and updates filter coefficients to set the error signal 245 to be zero The automatically set and updated filter coefficients are stored in the common memory 251. The filter coefficient sequentially stored in the common memory 251 are supplied to the calculator 253. The calculator 253 then obtains, e.g , the sum of and the difference between the latest filter coefficient and the previous filter coefficient. The resulting value is stored in the common memory 251 again. The output circuit 257 performs digital filtering of the input signal x by using the stored filter coefficient, and outputs the filtered signal as the output signal y. At this time, a sync clock from the sync clock generator 239 is used to synchronize the adaptive controller 235 and the output circuit 257

According to the above embodiment, the adaptive control apparatus can be formed as an integrated circuit (circuit elements are integrated on a substrate or are integrated into an IC as one chip). Therefore, the adaptive control apparatus can be reduced in size, and its filter coefficients can be simultaneously updated by using the common memory 251. This allows a quick response to a change in state of the adaptive control system. In the above embodiment, the common memory 251 is arranged to simultaneously update all the filter coefficients in response to a sync clock from the sync clock generator 239. In some adaptively controlled devices, however, a change in filter coefficient is not preferable.

When, for example, a sound is generated by an adaptive control apparatus of an acoustic system, an abrupt change in filter coefficient may occur due to an abrupt change in state of the acoustic system, and a pulse-like sound may be generated at the change point. In order to prevent this, filter coefficients are updated in units of taps or of several taps in synchronism with sampling clocks. It is apparent that if a filter system has N taps, a transfer operation of all the points of an impulse response function requires a period of time corresponding to N×sampling clock time. However, since the filter coefficients are updated in units of taps or of several taps, an abrupt change in output from the output circuit 257 can be prevented.

Figure 12:
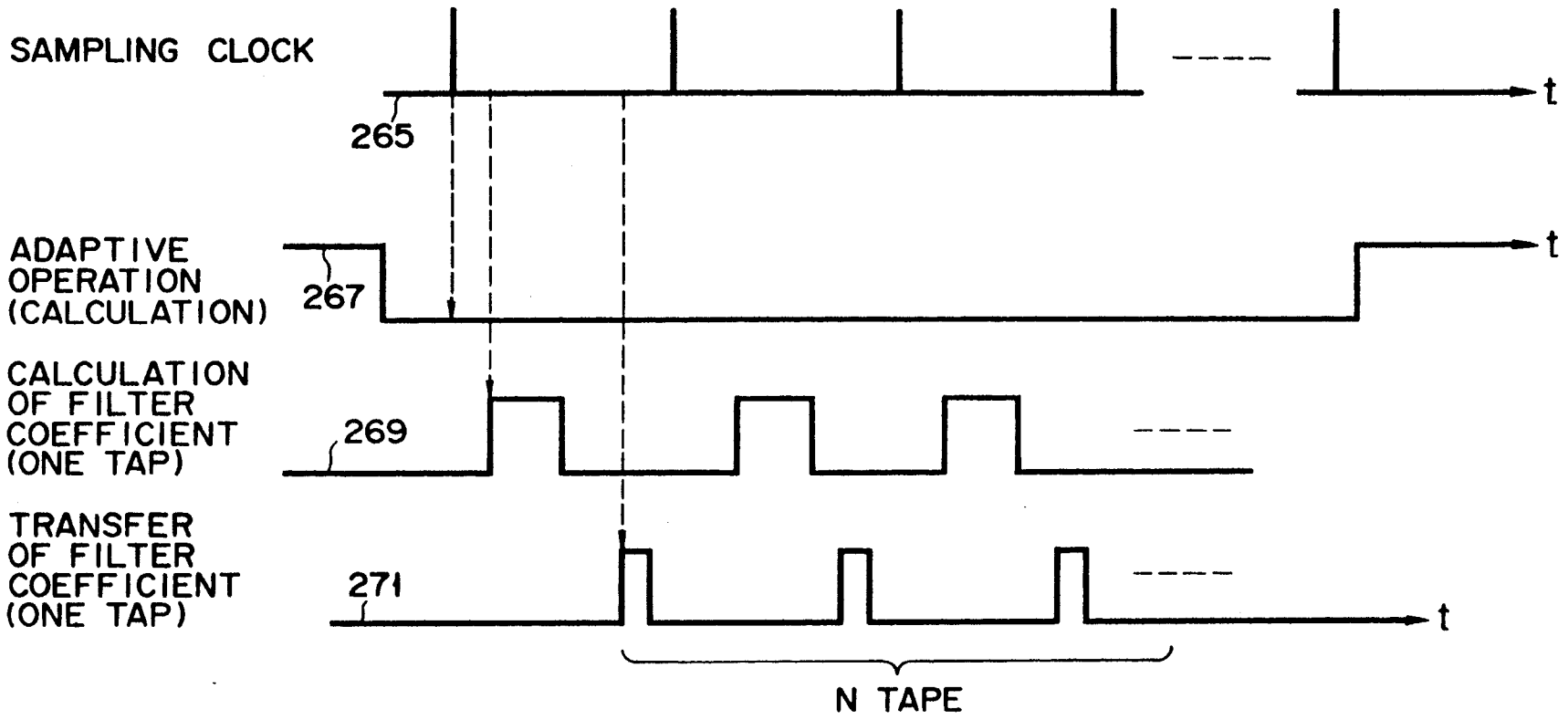
FIG. 12 is a timing chart for explaining an operation of the adaptive control apparatus.

As shown in FIG. 12, a sampling clock 265 is used for input/output operations. An adaptive operation 67 serves to stop the operation of the adaptive control apparatus after a desired period of time. At this time, filter coefficients obtained by the adaptive controller 235 are stored in the memory 251. The calculator 253 for obtaining the sum of and the difference between these filter coefficients executes calculations of filter coefficients for one tap or several taps after the sampling clock.

As is apparent from FIG. 12, the operation timings of a calculation 269 of a filter coefficient and transfer 271 of a filter coefficient are set such that these operations are ended in an interval between sampling clocks 265. This operation is performed to prevent a transfer operation from being executed in the process of an output operation of a calculation result obtained by the adaptive controller 235.

Figure 1:
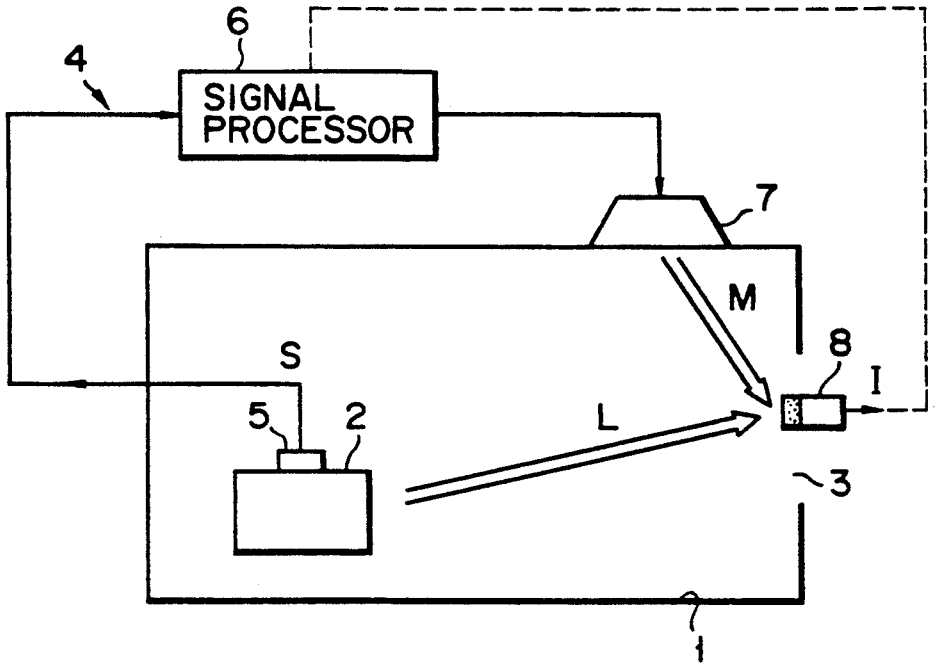
FIG. 1 (PRIOR ART)
FIG. 1 is a block diagram showing an arrangement of a conventional adaptive active noise cancellation apparatus.
Figure 2:
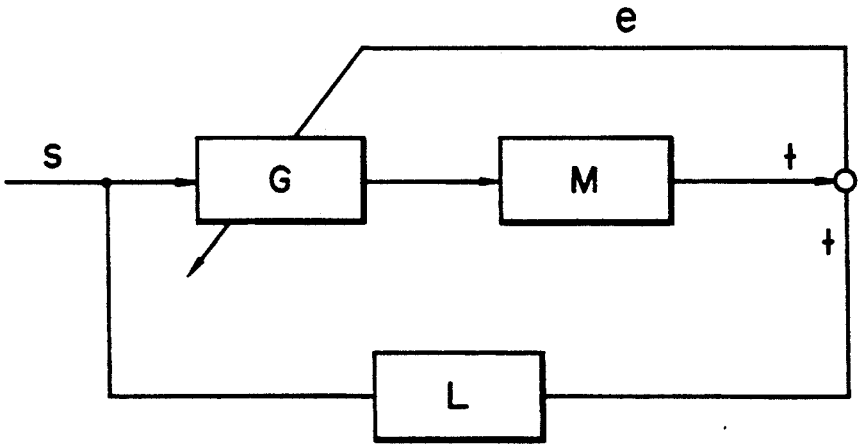
FIG. 2 (PRIOR ART)
FIG. 2 is an equivalent circuit diagram of FIG. 1.

According to the timing chart shown in FIG. 12, a common memory need not be integrated as in the arrangement shown in FIG. 1, but the respective circuit elements are independently used to be selectively connected to each other.

According to the embodiment described above, even if an error signal in the adaptive control apparatus needs to be corrected, since an integrated circuit for executing adaptive control and correction can be arranged, and parallel processing can be performed in synchronism with the common memory 251, a high-speed arithmetic operation can be realized. In addition, since the respective circuits can be integrated, the apparatus can be reduced in size. Especially, since an exclusive circuit is used to obtain coefficients when the error adaptive control method of obtaining a filter coefficient error and obtaining a true coefficient from the obtained difference is used, a corresponding control program can be simplified.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An adaptive active noise cancellation apparatus comprising:

first sensor means for detecting a sound generated by a sound source and outputting a detection signal;

filter means, having a predetermined filter coefficient, for filtering the output signal from said first sensor means by using the predetermined filter coefficient, and outputting a filtered signal;

sound generating means for receiving the filtered signal and generating a sound corresponding to the filtered signal;

an active noise cancellation control system for actively canceling a source sound at a control target point by using the sound generated by said sound generating means;

second sensor means, arranged at the control target point, for detecting a sound at the control target point and outputting a detection signal; and an adaptive control system for receiving the output signals from said first and second sensor means and adaptively updating the filter coefficient in accordance with a state of a system for which noise cancellation is to be performed by said active noise cancellation control system, wherein said adaptive control system comprises means for stopping said active noise cancellation control system in an adaptive operation, and a correction system for correcting the output signal from said first sensor means or said second sensor means by using a transfer function corresponding to a delay in a spatial system between said sound generating means and said second sensor means and a delay required for calculation processing, wherein said correction system comprises an inverse filter having an inverse function of the transfer function and arranged in an output signal path of said second sensor means.

2. An adaptive active noise cancellation apparatus comprising:

first sensor means for detecting a sound generated by a sound source and outputting a detection signal;

filter means, having a predetermined filter coefficient, for filtering the output signal from said first sensor means by using the predetermined filter coefficient, and outputting a filtered signal;

sound generating means for receiving the filtered signal and generating a sound corresponding to the filtered signal;

an active noise cancellation control system for actively canceling a source sound at a control target point by using the sound generated by said sound generating means;

second sensor means, arranged at the control target point, for detecting a sound at the control target point and outputting a detection signal; and an adaptive control system for receiving the output signals from said first and second sensor means and adaptively updating the filter coefficient of said filter means in accordance with a state of a system for which noise cancellation is to be performed by said active noise cancellation control system.

wherein said adaptive control system comprises means for stopping said active noise cancellation control system in an adaptive operation, and a correction system for correcting the output signal from one of said first sensor means and said second sensor means by using a transfer function corresponding to a spatial delay in a spatial system between said sound generating means and said second sensor means and an electrical delay required for calculation processing, said correction system including adaptive control means for obtaining a difference between a new filter coefficient obtained in accordance with a change in state of the system and a current filter coefficient, a first forward filter having the transfer function and which is coupled between an input terminal of said adaptive control means and an output terminal of said first sensor means and a second forward filter connected to an input terminal means of said means for adaptively updating the filter coefficient, for compensating for the spatial and electrical delays.

3. An adaptive active noise cancellation apparatus comprising:

first sensor means for detecting a sound generated by a sound source and outputting a detection signal;

filter means, having a predetermined filter coefficient, for filtering the output signal from said first sensor means by using the predetermined filter coefficient, and outputting a filtered signal;

sound generating means for receiving the filtered signal and generating a sound corresponding to the filtered signal;

an active noise cancellation control system for actively canceling a source sound at a control target point by using the sound generated by said sound generating means;

second sensor means, arranged at the control target point, for detecting a sound at the control target point and outputting a detection signal; and an adaptive control system for receiving the output signals from said first and second sensor means and adaptively updating the filter coefficient in accordance with a state of a system for which noise cancellation is to be performed by said active noise cancellation control system, wherein said adaptive control system comprises:

a correction system for correcting the output signal from one of said first sensor means and said second sensor means by using a transfer function corresponding to a delay in a spatial system between said sound generating means and said second sensor means and a delay required for calculation processing;

error coefficient calculating means for receiving the output signals which are output from said first and second sensor means and pass through said correction system, and obtaining a filter coefficient, as an error filter coefficient, so that a difference between an output of said error coefficient calculating means and the detection signal of said second sensor means comes to a minimum value while said active noise cancellation control system executes a noise cancellation operation; and means for obtaining a new filter coefficient from a difference between the error filter coefficient obtained by said error coefficient calculating means and a filter coefficient currently set in said active noise cancellation control system, and updating the filter coefficient of said active noise cancellation control system to the new filter coefficient.

4. An apparatus according to claim 4, wherein said correction system includes an inverse filter having an inverse function of the transfer function and arranged in an output signal path of said second sensor means.

5. An apparatus according to claim 3, wherein said correction system includes a forward filter having the transfer function and arranged in an output signal path of said first sensor means.

6. An apparatus according to claim 5, wherein said correction system includes a delay means arranged in a front stage of said error coefficient calculating means for compensating for the delay in a spatial system and the delay required for calculation processing.

7. An adaptive active noise cancellation apparatus comprising.

first sensor means for detecting a noise generated by a noise source and outputting a detection signal;

filter means, having a predetermined filter coefficient, for filtering the output signal from said first sensor means by using the predetermined filter coefficient, and outputting a filtered signal;

sound generating means for receiving the filtered signal and generating a sound corresponding to the filtered signal;

an active noise cancellation control system for actively canceling a noise at a control target point by using the sound generated by said sound generating means;

second sensor means, arranged at the control target point, for detecting a sound at the control target point and outputting a detection signal; and an adaptive control system for receiving the output signals from said first and second sensor means and adaptively updating the filter coefficient in accordance with a state of a system for which noise cancellation is to performed by said active noise cancellation control system, wherein said adaptive control system comprises:

first adaptive control means for receiving the output signals from said first and second sensor means and obtaining a filter coefficient based on a difference between a filter coefficient currently set in said active noise cancellation control system and a new filter coefficient to be set in said active noise cancellation control system while said active noise cancellation control system executes a noise cancellation operation, second adaptive control means for receiving the output signals from said first and second sensor means and obtaining a filter coefficient based on a sum of a filter coefficient currently set in said active noise cancellation control system and a new filter coefficient to be set in said active noise cancellation control system while said active noise cancellation control system executes a noise cancellation operation; and update control means for replacing the filter coefficient of said active noise cancellation control system with the new filter coefficient by using the filter coefficient based on the sum obtained by said second adaptive control means and the filter coefficient based on the difference obtained by said first adaptive control means.

8. An apparatus according to claim 7, wherein said first adaptive control means comprises a first adaptive controller for receiving the output signals from said first and second sensor means, and a forward filter having a filter coefficient corresponding to a transfer function between said sound generating means and said second sensor means and arranged in a signal path between said first sensor means and said first adaptive controller, and said second adaptive control means comprises a series circuit constituted by an amplifier for amplifying an input signal twofold, a first forward filter having a filter coefficient corresponding to a transfer function between said sound generating means and said sensor means, and a second filter having a filter coefficient equal to the filter coefficient set in said active noise cancellation control system, said series circuit causing the output signal from said first sensor means to pass through said amplifier, said first forward filter, and said second filter in the order named, an adder for adding the output signal, which is output from said first sensor means and passes through said series circuit, to the output signal from said second sensor means, a second adaptive controller for receiving the output signal from said first sensor means and an output signal from said adder, and a third forward filter having a filter coefficient corresponding to a transfer function between said sound generating means and said second sensor means and arranged in a signal path between said second adaptive controller and said first sensor means.

9. An apparatus according to claim 7, wherein said update control means comprises a fourth filter in which the filter coefficient based on the difference obtained by said first adaptive control means is set and which filters the output signal from said first sensor means, a fifth filter in which the filter coefficient based on the sum obtained by said second adaptive control means is set and which filters the output signal from said first sensor means, an adder for adding a signal filtered by said second filter to a signal filtered by said first filter, a third adaptive controller for receiving the output signal from said first sensor means and an output signal from said adder, an amplifier, arranged between said third adaptive controller and said first sensor means, for amplifying an input signal twofold, and means for transferring the filter coefficient obtained by said third adaptive controller, as the new filter coefficient, to said active sound cancellation control system.

10. An apparatus according to claim 7, wherein said update control means comprises means for adding the filter coefficient based on the difference obtained by said first adaptive control means to the filter coefficient based on the sum obtained by said second adaptive control means, and transferring a filter coefficient obtained by multiplying the sum filter coefficient by $-(\frac{1}{2})$, as the new filter coefficient, to said active sound cancellation control system.

11. An adaptive active noise cancellation apparatus comprising:

first sensor means for detecting a sound generated by a sound source and outputting a detection signal;

filter means, having a predetermined filter coefficient, for filtering the output signal from said first sensor means by using the predetermined filter coefficient, and outputting a filtered signal;

sound generating means for receiving the filtered signal and generating a sound corresponding to the filtered signal;

an active noise cancellation control system for canceling a source sound at a control target point by using the sound generated by said sound generating means;

second sensor means, arranged at the control target point, for detecting a sound at the control target point and outputting a detection signal; and an adaptive control system for receiving the output signals from said first and second sensor means and adaptively updating the filter coefficient in accordance with a state of a system for which noise cancellation is to be performed by said active noise cancellation control system, wherein said adaptive control system comprises:

a plurality of adaptive control circuits for setting and updating a filter coefficient such that an output signal becomes a desired signal;

error coefficient calculating means for receiving the output signals which are output from said first and second sensor means and pass through said correction system, and obtaining a filter coefficient, as an error filter coefficient, so that a difference between an output of said error coefficient calculating means and the detection signal of said second sensor means comes to a minimum value while said active noise cancellation control system executes a noise cancellation operation;

means for obtaining a new filter coefficient from a difference between the error filter coefficient obtained by said error coefficient calculating means and a filter coefficient currently set in said active noise cancellation control system;

storage means for storing a previous filter coefficient and the new filter coefficient;

calculation means for calculating one of a sum of the previous filter coefficient and the new filter coefficient and a difference therebetween;

output means for digitally filtering an input signal in accordance with a result obtained by said calculation means;

bus line means coupling said memory means to each of said adaptive control circuits, said calculation means and said output means, for transferring the signal between said memory means and each of said adaptive control circuits, said calculation means and said output means;

clock generating means for generating a clock for setting an operation timing between said adaptive control means and said output means; and transfer function correcting means connected to an input terminal means of said adaptive control means, for filtering the input signal, using a filter coefficient corresponding to a transfer function between an adaptive control evaluation point and a device to be adaptively controlled by said output signal.

12. An apparatus according to claim 11, wherein said storage means comprises first storage means for storing the previous filter coefficient, and second storage means for storing the new filter coefficient, and said calculation means includes parallel operation processing means for executing a parallel operation process between said first storage means and said second storage means.

13. An apparatus according to claim 11, wherein when said output means outputs the output signal, using the filter coefficient obtained by said transfer function correcting means and said adaptive control circuits, each of said adaptive control circuits has a plurality of taps which are divided into a plurality of tap groups, and the filter coefficients are output for each of the tap groups in synchronism with the clocks generated from said clock generating means and in accordance with each of the tap groups.

* * * * *